US005236038A

United States Patent [19]

Clemishire

[11] Patent Number: 5,236,038

[45] Date of Patent: Aug. 17, 1993

[54] PUMP SHAKER

[76] Inventor: Steve Clemishire, 219 E. 13th, Hominy, Okla. 74035

[21] Appl. No.: 843,147

[22] Filed: Feb. 28, 1992

[51] Int. Cl.[5] ..... E21B 23/00

[52] U.S. Cl. ..... 166/178; 417/545; 92/172

[58] Field of Search ..... 92/172; 417/545, 547; 166/178

[56] References Cited

U.S. PATENT DOCUMENTS

| | | | |
|---|---|---|---|
| 2,176,766 | 10/1939 | Johnston | 166/178 |
| 2,203,595 | 6/1940 | Hall et al. | 166/178 |
| 2,690,226 | 9/1954 | Comstock | 166/178 |
| 3,036,647 | 5/1962 | McCracken | 166/178 |
| 3,217,817 | 11/1965 | Morrisett et al. | 166/178 |
| 3,724,576 | 4/1973 | Roberts | 166/178 |
| 3,834,471 | 10/1974 | Bottoms | 166/178 |
| 4,963,078 | 10/1990 | Agee | 417/545 |
| 5,069,282 | 12/1991 | Taylor | 166/178 |

FOREIGN PATENT DOCUMENTS

| | | | |
|---|---|---|---|
| 531305 | 10/1956 | Canada | 166/178 |
| 561778 | 7/1977 | U.S.S.R. | 166/178 |

*Primary Examiner*—Thomas E. Denion
*Attorney, Agent, or Firm*—William S. Dorman

[57] ABSTRACT

The invention is a device which can be screwed into the rod string near or at the downhole pump for the purpose of shaking the pump with each stroke of the sucker rod in order to free a stuck or obstructed ball valve located in the pump. The device is formed from three metal parts, two of which fit together forming a compartment having a ceiling and a floor. The floor is formed by sides of the square opening which communicates between the compartment and the well. The metal parts forming the compartment attach to the rod string leading to the wellhead. The third part comprising the device is a piston having a cylinder head which is movably confined within the compartment and having a square neck which extends through the square opening and attaches to either the pump or a sucker rod located near the pump. The head will move within the cylinder and bump against either the ceiling or the floor in response to the up and down movement of the sucker rod, and each time the head bumps, the piston transmits the impact to the pump, thus shaking the pump.

7 Claims, 3 Drawing Sheets

PUMP SHAKER

BACKGROUND OF THE INVENTION

1. Field of the Invention

The present invention relates to a new device for shaking a pump located downhole in a well for the purpose of freeing a stuck or obstructed ball valve located in a valve cage of the downhole pump. More specifically, the present invention is a device having a top end provided with a cap which screws into a sucker rod coupling and a bottom end provided with a piston which screws into either a sucker rod coupling or the pump, the device thus forming a link in the rod string at or near the downhole pump. The cap attaches to a cylinder forming a ceiling for a compartment located within the cylinder. The compartment has an opening which forms a floor for the compartment and through which the piston extends so that a head of the piston is movably confined within the compartment. The head travels within the compartment in response to the up and down movement of the rod string, striking the ceiling or floor of the cylinder with each stroke, thus shaking the downhole pump.

2. The Prior Art

A preliminary search was conducted on the invention disclosed herein, and the following listed patents were uncovered in the search:

| U.S. Pat. No. | Inventor | Issue Date |
|---|---|---|
| 969,489 | J. B. Oeink | Sept. 6, 1910 |
| Re 20,312 | P. G. Gates | March 30, 1937 |
| 2,245,128 | C. J. Gardner | June 10, 1941 |
| 2,687,179 | N. B. Dismukes | Aug. 24, 1954 |
| 3,036,647 | O. L. McCracken | May 29, 1962 |
| 3,209,834 | R. L. Essary | Oct. 5, 1965 |
| 3,642,069 | Adkins | Feb. 15, 1972 |
| 4,846,273 | Anderson, et al. | July 11, 1989 |

Pumps used downhole in wells normally are provided with ball valves which allow gases and fluids to move upward from the pump but prevent them from moving downward again. Frequently during operation, these ball valves become stuck or a piece of debris becomes lodged therein, preventing the valve from operating properly. When a ball valve becomes stuck or obstructed, a way of freeing the valve is needed.

Several methods have been employed to clear valves on downhole pumps. One method includes lowering the pump to the bottom of the well so the pump scopes together in the hope that this maneuver will free the valve. This method can damage the pump or loosen the pump threads when the pump is scoped together.

Another method employed to clear the valve on downhole pumps includes pulling the pump out of the well and physically freeing the valve. This method is time consuming and costly and, therefore, is usually employed as a method of last resort.

Devices for mechanically moving the ball in order to clear the valve downhole have been incorporated into the design of pumps. For example, U.S. Pat. No. 969,489 reveals a pump part including a pin which strikes the ball on the downward stroke, thus knocking the ball free.

These pump devices have several problems. First, they must be made to fit each pump size and design. Because of the large number of pump sizes and designs, a large inventory is required to be kept in stock in order to be able to quickly fit a pump which might require a replacement for this part.

Second, these devices are part of the pump and are essential to the pump's function. They cannot be removed from the pump or placed onto the rod string anywhere except in the pump. Removable of the devices requires disassembly of the pump, a procedure which is costly and time consuming and, therefore, is undesirable.

Finally, U.S. Pat. No. 969,489 is designed to fit a tubing pump. The device does not fit a modern pull-rod insert pump and possibly will not work on any of the modern day insert pump and plunger lift systems.

The remaining patents listed above are not considered sufficiently pertinent as to require any comment.

The present invention overcomes the problems of prior art devices for clearing ball valves downhole by employing universal threading for use on standard rod sizes. This allows the invention to fit a wide range of wells with only a few sizes which are threaded for standard rod threads, thus reducing the cost of production and inventory of the devices.

The present invention screws onto the rod string as a joint in the rod string. It can be installed anywhere in the rod string and can be removed simply by unscrewing it at both of its ends from the rod string and reconnecting the rod string.

Finally, the present invention is designed to fit and function on modern insert pump and plunger lift systems.

SUMMARY OF THE INVENTION

The invention is a pump shaker for shaking a downhole pump. The pump shaker has a cap at its top end provided with upper cap threads which screw into a rod string which leads to the wellhead. The cap is provided with lower cap threads which screw into an upper internal-threaded end of a hollow cylinder, the cap thus forming a ceiling for a compartment located within the cylinder. The cylinder has a lower end which is provided with a square opening which communicates between the compartment and the well. Said square opening has sides which form a floor for the compartment. The cylinder is also provided with holes which communicate with the compartment in order to prevent build up of pressure or vacuum within the compartment.

A cylindrical head on a piston is movably confined within the compartment and moves in response to the up and down movement of the rod string, bumping sequentially against the ceiling and floor. The piston is provided with a square neck which slidably extends through the square opening, and is provided at a bottom end of the pump shaker with piston threads which screw into either the pump or a sucker rod attached to and located near the pump. Each time the head bumps against the ceiling or floor, the piston transmits the impact to the pump, thus shaking the pump.

DESCRIPTION OF THE PREFERRED EMBODIMENTS

Figure 1:
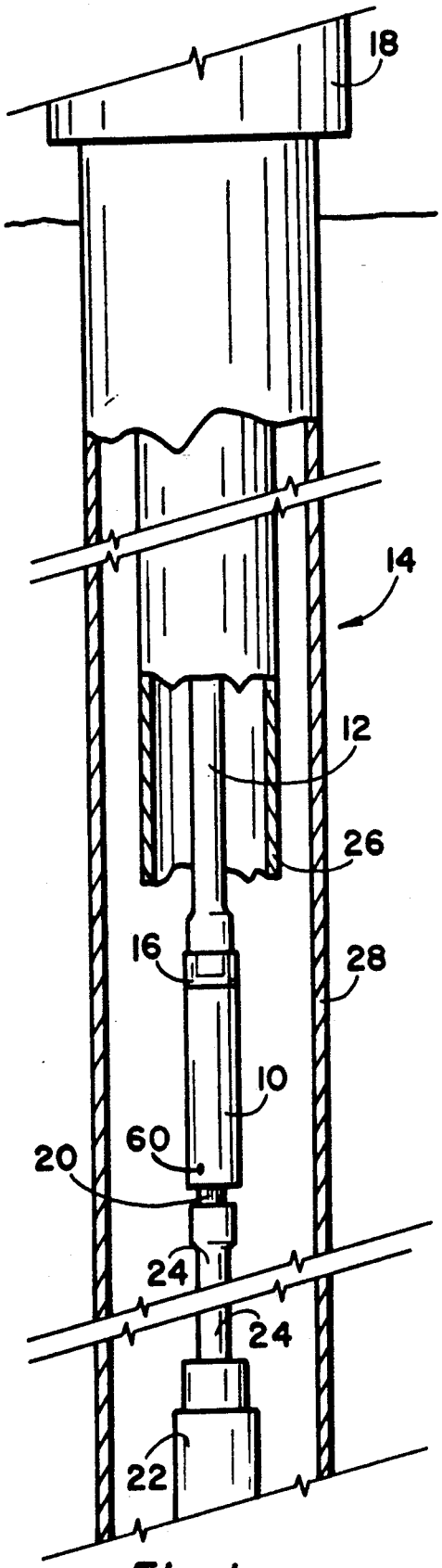
FIG. 1 is an enlarged side view of a preferred embodiment of a pump shaker constructed in accordance with the principles of the present invention, shown installed on a rod string.

Referring now to the drawings and initially to FIG. 1, there is illustrated a pump shaker constructed according to a preferred embodiment of the present invention, generally designated by the reference numeral 10. The pump shaker 10 is installed in a rod string 12 within a well 14. The pump shaker 10 has a top end 16 which faces upward and screws onto a portion of the rod string 12 which extends out of the well 14 at a wellhead 18.

The pump shaker 10 also has a bottom end 20 which faces downward and screws either into a downhole pump 22 or a sucker rod 24 of the rod string 12 which is attached to and located near the pump 22. The rod string 12 and the attached pump shaker 10 lie within tubing 26, which in turn lies within a casing 28 of the well 14.

Figure 2:
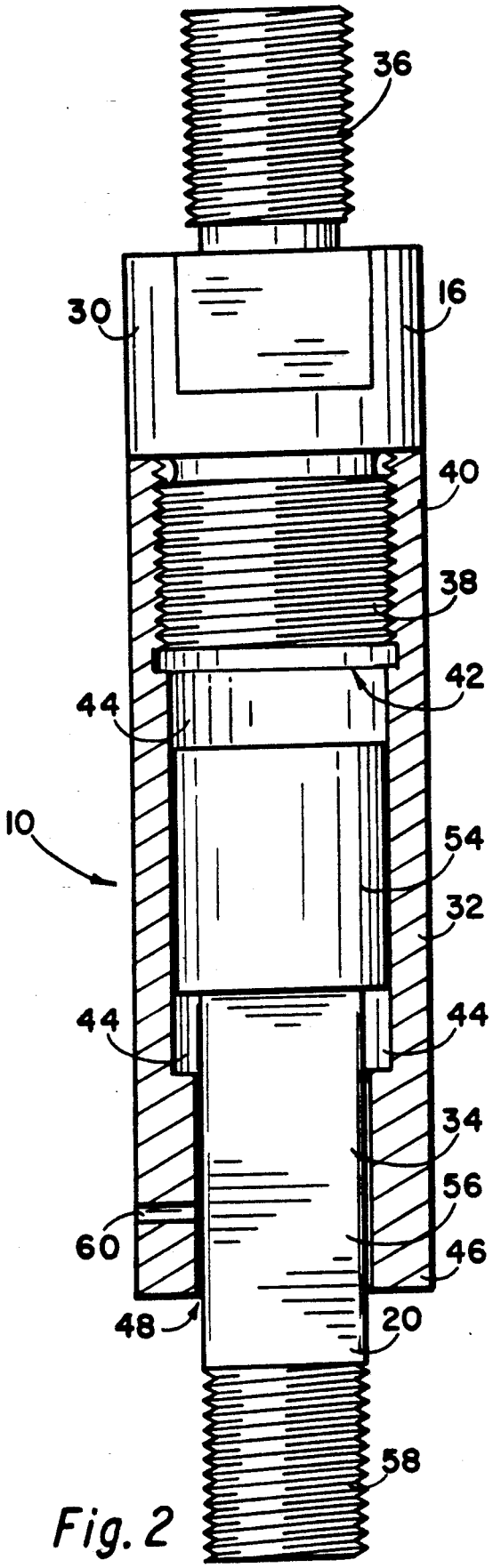
FIG. 2 is a side view of a preferred embodiment of a pump shaker constructed in accordance with the principles of the present invention.
Figures 3, 4:
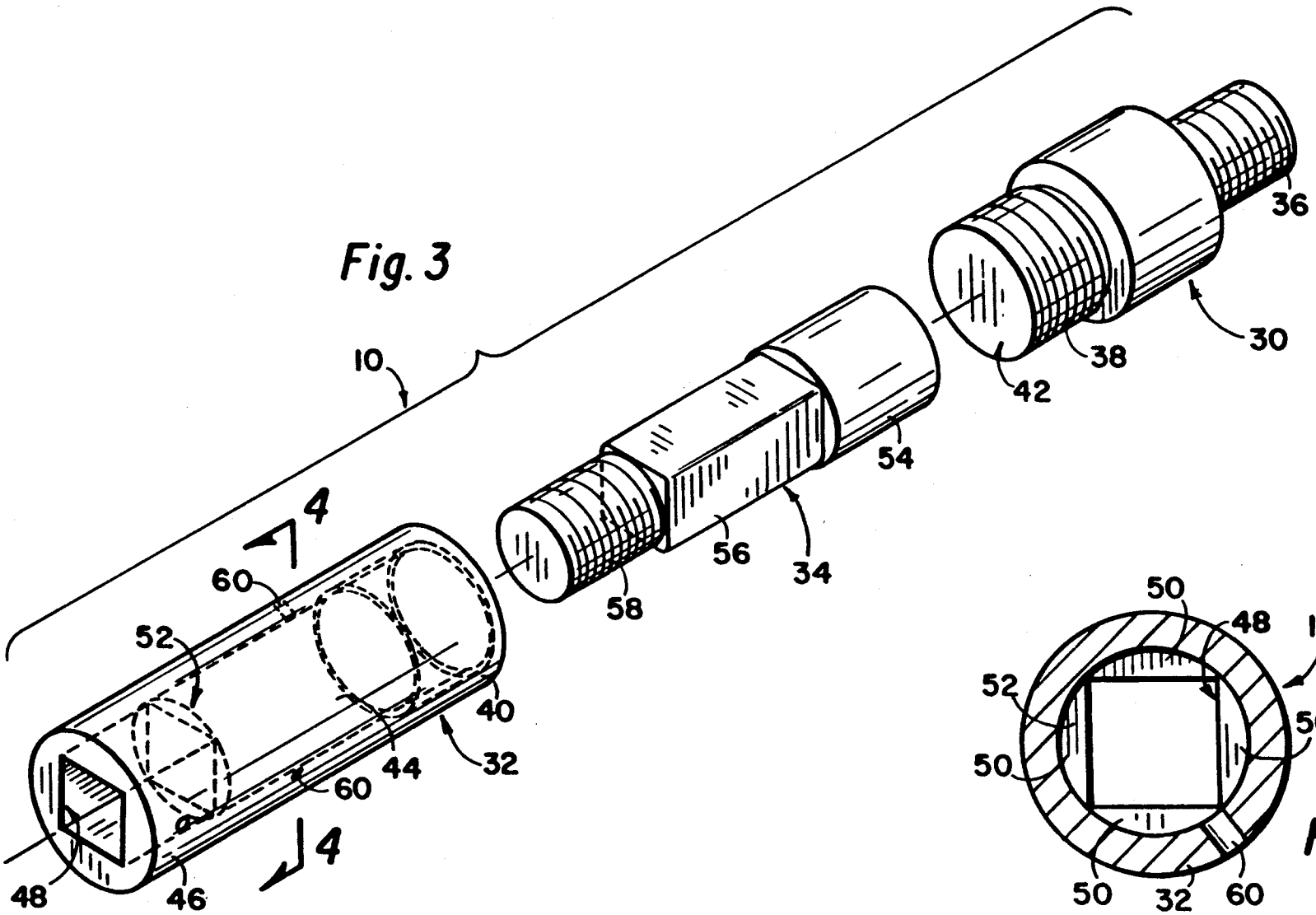
FIG. 3 is an exploded view of the pump shaker pictured in FIG. 2.
FIG. 4 is a cross-sectional view of the pump shaker taken along line 4—4 of FIG. 3.

Referring now to FIGS. 2, 3 and 4, the pump shaker 10 comprises three parts: a cap 30, a hollow cylinder 32 and a piston 34. The cap 30 is located at the top end 16 and screws into the rod string 12 via upper cap threads 36 provided on the cap 30.

The cap 30 is provided with lower cap threads 38 which screw into an upper internal threaded end 40 provided on the cylinder 32, forming a ceiling 42 on a cylindrical compartment 44 located within the cylinder 32. The cylinder 32 has a lower end 46 provided with a square opening 48 which communicates with the compartment 44. Smooth sides 50 of the square opening 48 form a floor 52 for compartment 44 where the square opening 48 enters the cylindrical compartment 44.

The piston 34 has a cylindrical head 54 slightly smaller in diameter than the cylindrical compartment which is movably confined within the compartment 44 and moves between the ceiling 42 and the floor 52 of the compartment 44. The piston is provided with a square neck 56 slightly smaller than the square opening 48 so the square neck 56 slidably extends through the square opening 48. The piston 34 is provided with piston threads 58 at the bottom end 20. Said piston threads 58 screw into either the pump 22 or the sucker rod 24 which is attached to and located near the pump 22. The pump shaker 10 is normally installed as close to the pump 22 as possible for most efficient shaking of the pump 22.

Holes 60 are provided in the cylinder 32 to prevent a build up of pressure or a vacuum within the compartment 44.

Although the opening 48 and the neck 56 have been described as being square, other shapes are possible.

The pump shaker 10 functions to shake the pump 22 whenever the rod string 12 moves upward by causing the cylinder 32 to move upward relative to the piston 34 until the head 54 bumps against the floor 52 of the compartment 44. As the head 54 bumps against the floor 52, the piston 34 transmits the impact to the pump 22, thus shaking the pump 22.

The pump shaker 10 also functions to shake the pump 22 whenever the rod string 12 moves downward by causing the cylinder 32 to move downward relative to the piston 34 until the head 54 bumps against the ceiling 42. As the head 54 bumps against the ceiling 42, the piston 34 transmits the impact to the pump 22, thus shaking the pump 22.

Figure 5:
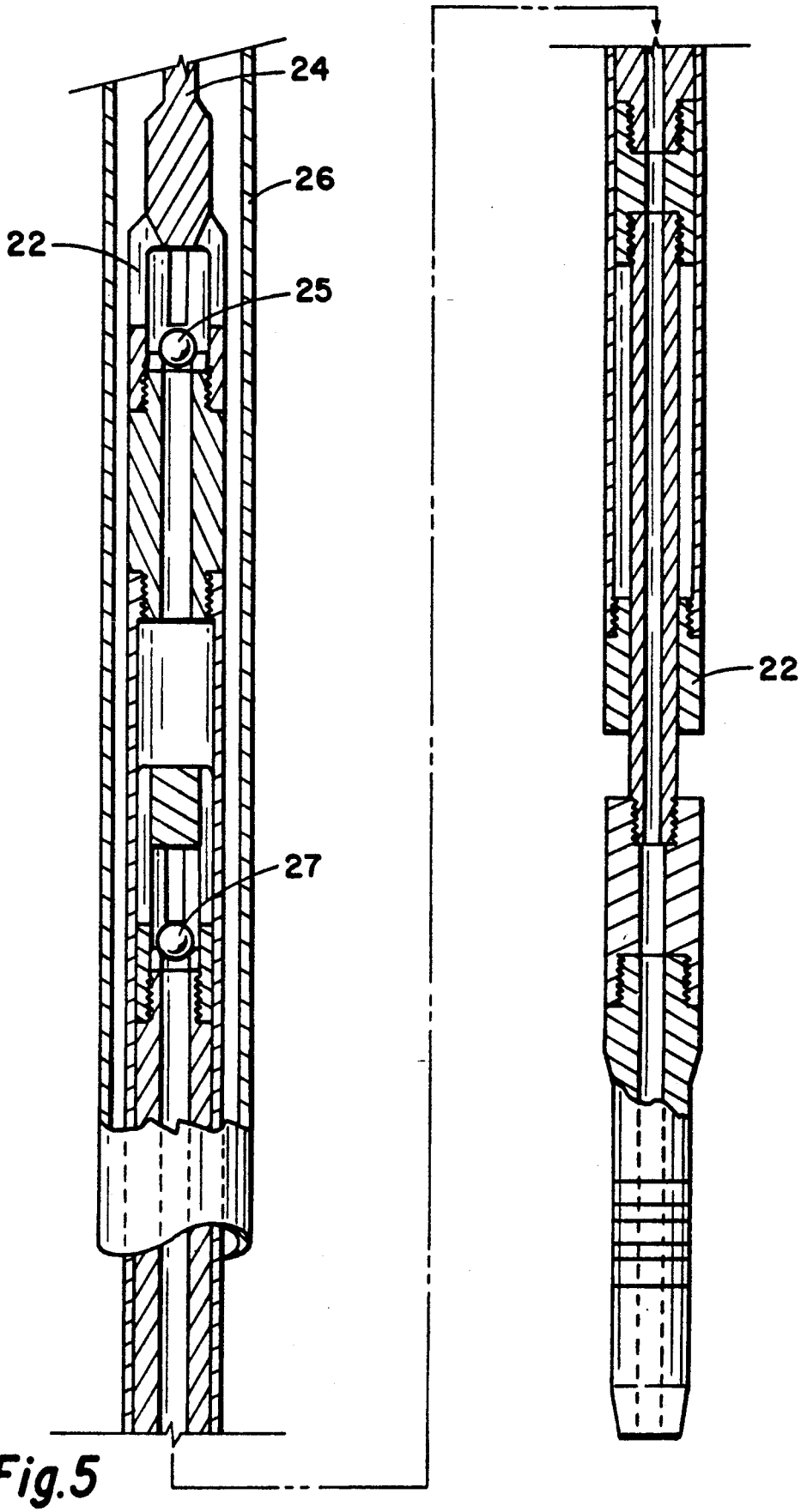
FIG. 5 is a broken view with certain parts in section and certain parts broken away of a conventional downhole pump.

FIG. 5 shows a conventional pump 22 connected to a sucker rod 24 and mounted for reciprocation with a tubing 26. Within the pump 22 there are two ball valves or balls 25 and 27 each surrounded by a ball cage. Briefly stated, when the upper part of the pump connecting to the ball 25 moves downwardly with respect to the stationary part of the pump and the ball 27, any liquid trapped between the two balls is forced upwardly past the ball 25 while the ball 27 remains seated as a result of the pressure above it. After the upper part of the pump 22 reaches its downstroke and thereafter commences to move upwardly, any liquid above the ball 25 is lifted upwardly in the tubing 26 during this upstroke; at the same time the reduced pressure above the ball 27 will cause it to lift so that the liquid again flows into the space between the two balls. If either of the two balls 25 or 27 become stuck due to debris or gas, the pump 22 will not function properly. Thus, when the impact of the piston 34 is transmitted to the pump 22, this force will prevent the balls 25 and 27 from becoming stuck or, if stuck, will be dislodged.

Whereas, the present invention has been described in particular relation to the drawings attached hereto, it should be understood that other and further modifications, apart from those shown or suggested herein, may be made within the spirit and scope of this invention.

What is claimed is:

1. In combination with a rod string mounted within a tubing which in turn lies within a casing of a well, the rod string having a bottom end connected to a downhole pump, the pump being provided with at least one ball valve which allows fluids to move upward from the pump and wherein said ball is movable between an operative position and a stuck position, a pump shaker for freeing said ball valve from said stuck position comprising a hollow cylinder having an internal compartment therein, the compartment having a ceiling and a floor, a piston movable within the compartment so as to bump against said ceiling and said floor, the cylinder being provided with a top end adapted to attach to the rod string above the pump, the piston being provided with a neck which projects downwardly through an opening in a bottom of said cylinder, the neck being provided with means for attaching the same to said pump whereby, upon reciprocation of the rod string, the piston will bump against the ceiling and the floor to dislodge said ball valve from said stuck position.

2. The combination according to claim 1 wherein the cylinder is provided with holes which communicate with the compartment in order to prevent a build up of pressure or vacuum within the compartment.

3. The combination according to claim 1 further comprising the top end being provided with a cap, said cap being provided with upper cap threads which attach to the rod string, said cap being provided with lower cap threads which attach to an upper internal-threaded end of the cylinder.

4. The combination according to claim 3 further comprising an opening which communicates with the compartment being provided in the cylinder at its lower end, the ceiling of the cylinder being formed by the cap, the floor of the cylinder being formed by sides of the opening.

5. The combination according to claim 4 further comprising a head being provided on the piston, said head being movably confined within the compartment and moving between the ceiling and the floor, said neck being provided on the piston which slidably extends through the opening, piston threads being provided on the piston at the bottom end of the pump shaker.

6. The combination according to claim 5 wherein the piston threads attach to a sucker rod in the rod string.

7. The combination according to claim 5 wherein the piston threads attach to the pump.

* * * * *